United States Patent [19]

Lind

[11] 4,232,651

[45] Nov. 11, 1980

[54] WOOD BURNING FURNACE

[75] Inventor: Eugene L. Lind, Aitkin, Minn.

[73] Assignee: Lind's Manufacturing Inc., Aitkin, Minn.

[21] Appl. No.: 56,026

[22] Filed: Jul. 9, 1979

[51] Int. Cl.[3] ..... F24H 3/02

[52] U.S. Cl. ..... 126/110 E; 126/99 A; 126/99 D; 126/109

[58] Field of Search ..... 126/112, 110 R, 99 D, 126/99 A, 110 E, 109, 104 R, 106, 99 R, 108

[56] References Cited

U.S. PATENT DOCUMENTS

| | | | |
|---|---|---|---|
| 115,270 | 5/1871 | Blackman | 126/109 |
| 284,545 | 9/1883 | Fair | 126/109 |
| 431,151 | 7/1890 | Riddell | 126/109 |
| 438,887 | 10/1890 | Houghton | 126/99 D |
| 672,845 | 4/1901 | Beech | 126/104 R |
| 1,026,777 | 5/1912 | Swett | 126/104 R |
| 1,528,758 | 3/1925 | Ellison | 126/104 R |
| 2,227,449 | 1/1941 | Gillmor | 126/109 |
| 2,291,145 | 7/1942 | Buck | 126/110 R |
| 3,388,697 | 6/1968 | Muckelrath | 126/109 |
| 4,020,822 | 5/1977 | Harris | 126/112 |

*Primary Examiner*—James C. Yeung
*Assistant Examiner*—Daniel O'Connor
*Attorney, Agent, or Firm*—Kinney, Lange, Braddock, Westman and Fairbairn

[57] ABSTRACT

A wood burning furnace includes a combustion enclosure made up of a lower closed generally rectilinear fire box which is defined at an upper portion thereof by a semicylindrical roof dome and a top cylindrical-shape smoke chamber supported on a rearward upright cylindrical smoke conduit and a forward upright smoke conduit, these conduits being supported on the fire box roof dome and open between the smoke chamber and fire box. The combustion enclosure is supported inside of a furnace shell above a fan compartment in that shell. The furnace shell and heating air baffles fastened to it are so constructed as to provide a heating air passage between the combustion enclosure and shell, and a blower in the fan compartment forces air from outside of the shell over the surfaces of the combustion enclosure and out the top of the shell to a location for use of heated air.

The configuration of the shell and air baffles on the one hand and of the combustion enclosure on the other is such that there will be a uniform rate of air flow over practically the entire surface of the combustion enclosure and over the entire involved surface of the furnace shell and air baffles to the end that heating and cooling of the combustion enclosure on the one hand and of the involved surfaces of the air baffles and furnace shell on the other will take place at a uniform rate throughout these entities so that no tendency for non-uniform expansion and contraction due to temperature change will result.

7 Claims, 6 Drawing Figures

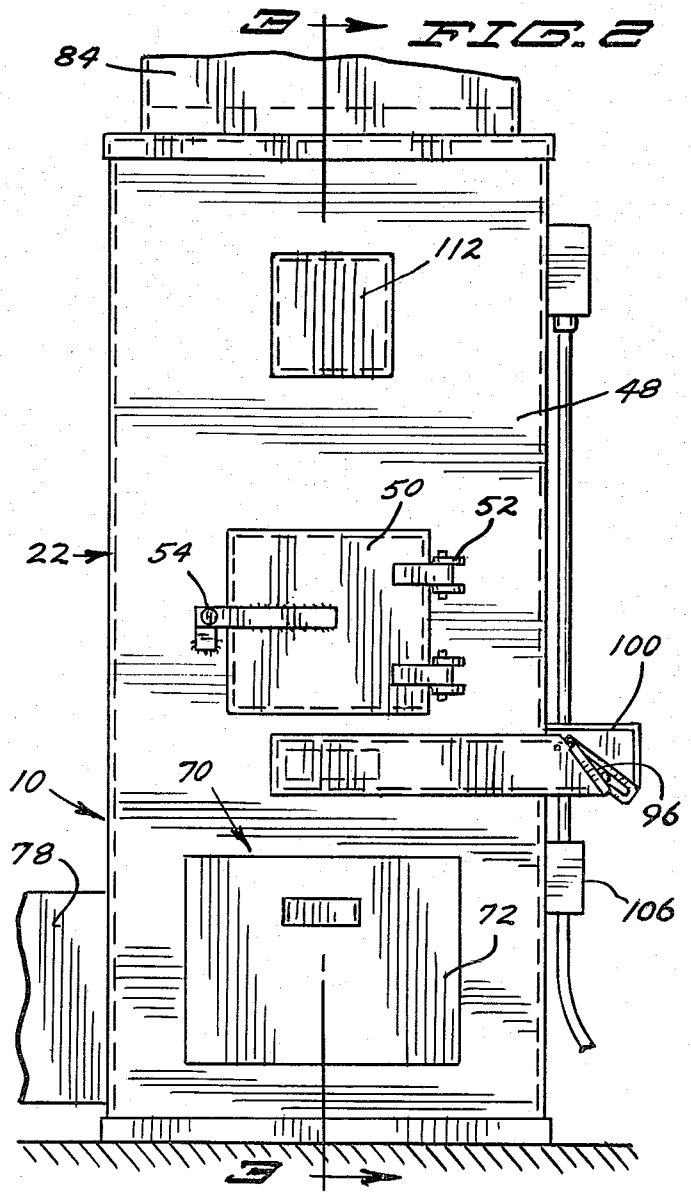
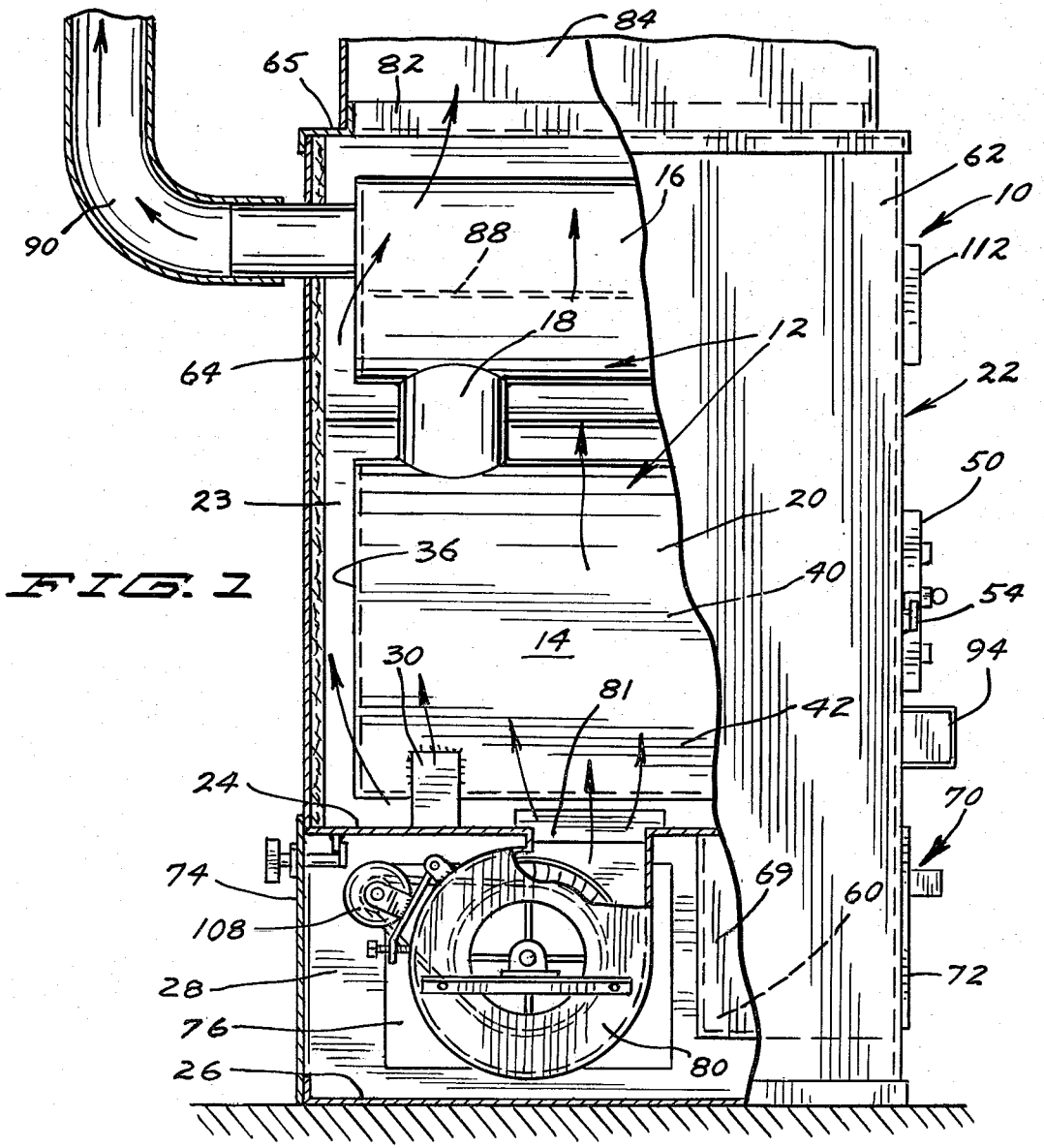
FIG. 1

WOOD BURNING FURNACE

BACKGROUND OF THE INVENTION

This invention has relation to a furnace designed to burn wood and to provide forced hot air heating for a home or other building enclosure.

It is known to provide a furnace for burning wood with an upper combustion chamber and a lower combustion chamber or fire box and with vertical smoke passageways separating the chambers. Such structures have also been provided with spaced outer jackets completely surrounding the combustion chamber except for a fire door, a lower draft opening, an upper cleanout opening for the upper combustion chamber, and a stack extending out from the top of the upper combustion chamber. Forced air has been provided between this jacket and the combustion chambers by the use of a centrifugal fan set in a blower compartment beneath the fire box and discharging into the air passageway between the outer shell and the fire box. However, the combustion chambers of such prior art structures have been constructed of sheet metal with sharp angular breaks and bends therein. Such prior art structures have suffered from the difficulty that uneven heat spots are created, causing the metal jackets and the metal of the combustion chambers to warp out of shape and fail under ordinary usage and service.

An earlier model of wood burning furnace constructed as set out above had the wood fire laid directly on the bottom of the lower combustion chamber, with the ashes and other residue being removable only by scraping the residue forward and shoveling it out of the fire door or out of the draft opening. This usually or most often resulted in the necessity for rekindling the fire after every such emptying of ashes.

In order to overcome these deficiencies, and to produce a more efficient wood burning furnace, the furnace of the present invention was developed.

No preliminary search has been made in the records of the U.S. Patent and Trademark Office in regard to this invention. In addition to the prior art described above, applicant is familiar with the log furnaces manufactured and sold by Earth Stove Northwest of P.O. Box 549, Tualatin, Ore. 97062. A photocopy of their brochure identified as 2/792M PP is presented herewith together with a photocopy of a phantom outline drawing of their model LFV 200 furnace. It is evident that the rectilinear construction of the top of their stainless steel fire box and of their rectilinear stainless steel heat exchanger take this structure outside of the concept of the present invention.

Neither applicant nor those in privity to him know of any prior art structures which anticipate the present invention and they know of no prior art which anticipates any of the claims made herein.

BRIEF SUMMARY OF INVENTION

A furnace for burning wood and other solid fuel includes a combustion enclosure inside of an outer furnace shell, the combustion enclosure and shell being spaced from each other to provide for a heating air passage therebetween. A blower in a fan compartment below the combustion enclosure forces heating air over the surface of the combustion enclosure inside of the furnace shell to heat that air and to deliver it to locations for use. Such structures are known to the prior art, but the construction of such combustion enclosures and outer furnace shells has been such that the combustion enclosures and other parts have not heated and cooled uniformly over all parts thereof, and hence they have expanded and contracted at differing rates, whereby warping and eventual failure has often taken place.

The solid fuel burning furnace of the invention provides for a combustion enclosure including a closed, generally rectilinear, lower fire box having an upper portion thereof constituted as a semicylindrical roof dome. It also provides for a closed, cylindrical, upper smoke chamber spaced above and parallel to the fire box roof dome, and for rearward and forward smoke conduits open between the fire box roof dome and the smoke chamber at rearward and forward portions of each, respectively. Heating air baffles are provided inside of the furnace shell. The shape of the furnace shell itself and of these baffles is such as to provide for a heating air passage in which the rate of air flow over the various surfaces of the combustion enclosure will be substantially uniform to the end that no single portion of the combustion enclosure will develop spots of substantially greater temperature than other parts of the combustion enclosure and no parts of this enclosure will be so cooled that temperatures of substantially less than the temperature of the rest of the enclosure will be developed at any particular point in time.

This uniform air flow pattern will also result in substantially uniform temperatures throughout the defining walls of the furnace shell and of the air baffles.

By providing this means for positively insuring that the temperatures within the combustion enclosure and also the temperatures within the furnace shell will rise and fall substantially uniformly throughout each such entity, the tendency for each of these entities to expand and/or contract more rapidly at one place than at another is eliminated, and thus there will be no substantial warping over the effective life of the furnace.

IN THE DRAWINGS

FIG. 1 is a side elevational view of a wood burning furnace made according to the present invention with parts in section and parts broken away;

FIG. 4 is a vertical sectional view taken on the line 4—4 in FIG. 3;

DESCRIPTION OF PREFERRED EMBODIMENT

Figure 2:
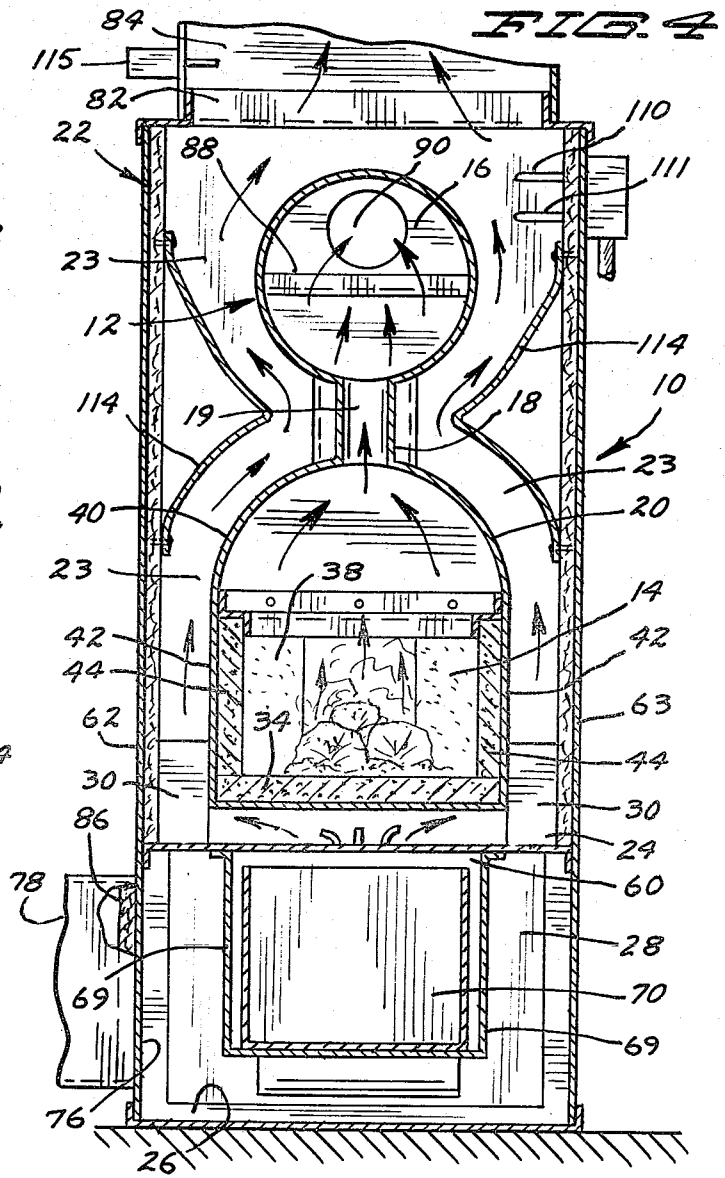
FIG. 2 is a front elevational view of the furnace of FIG. 1 as seen from the right in that figure.

A wood burning furnace 10 made according to the present invention includes a two phase combustion zone or enclosure 12 made up of a lower fire box 14 and an upper smoke chamber 16, and rearward and forward smoke conduits 18 and 19 open between the lower fire box and the upper smoke chamber. These conduits support the upper smoke chamber on the fire box.

In the form of the invention shown, the fire box is generally rectilinear in shape but has a semicylindrical dome defined as fire box roof 20. The forward and rearward smoke conduits are cylindrical, the forward conduit being smaller in diameter than the rearward conduit. These conduits open through the fire box roof 20 into the bottom of the upper smoke chamber 16 which is cylindrical in configuration. An outer generally rectilinear furnace shell 22 is for the purpose of providing a heating air passage 23 around the entire combustion zone 12. A horizontal partition 24 parallel to, spaced from and below the floor of the fire box 14 is for the purpose of partially defining, with a shell floor 26 and vertical outer side walls 62 and 63 of the shell 22, a fan compartment 28. The lower fire box 14, and hence the weight of all of the two phase combustion zone 12, is supported on legs 30 above the fan compartment 28.

The fire box 14 includes a sheet metal floor 32 covered with horizontally laid fire brick 34, a vertical rear end wall 36 faced on its lower portion with fire brick 38, and a vertical front end wall 37. Vertical side walls 42,42 and the semicylindrical dome shape roof 20 together form an inverted U-shape outer fire box envelope 40. The vertical side walls 42,42 are faced with fire brick 44,44. A rectangular fire box loading collar 46 extends through a vertical front wall 48 of the outer shell 22, and an insulated fire door 50 is pivotally mounted as at 52 and is fastenable as at 54 to the wall 48. When the fire door is opened, wood, kindling, and fire can be introduced into the fire box to initiate combustion within the furnace.

At a forward edge of the fire box 14, an opening 56 is provided through the floor 32 of the fire box, and a grate 58 is provided across that opening. This is for the purpose of periodically raking what little ashes result from the wood fire forward off the horizontal fire brick floor 34 into an ash compartment 60 below.

In addition to the vertical front wall 48, the outer furnace shell 22 is defined by the vertical side walls 62 and 63 and a vertical rear wall 64 as well as a horizontal top wall 65 and the aforementioned shell floor 26.

Figure 3:
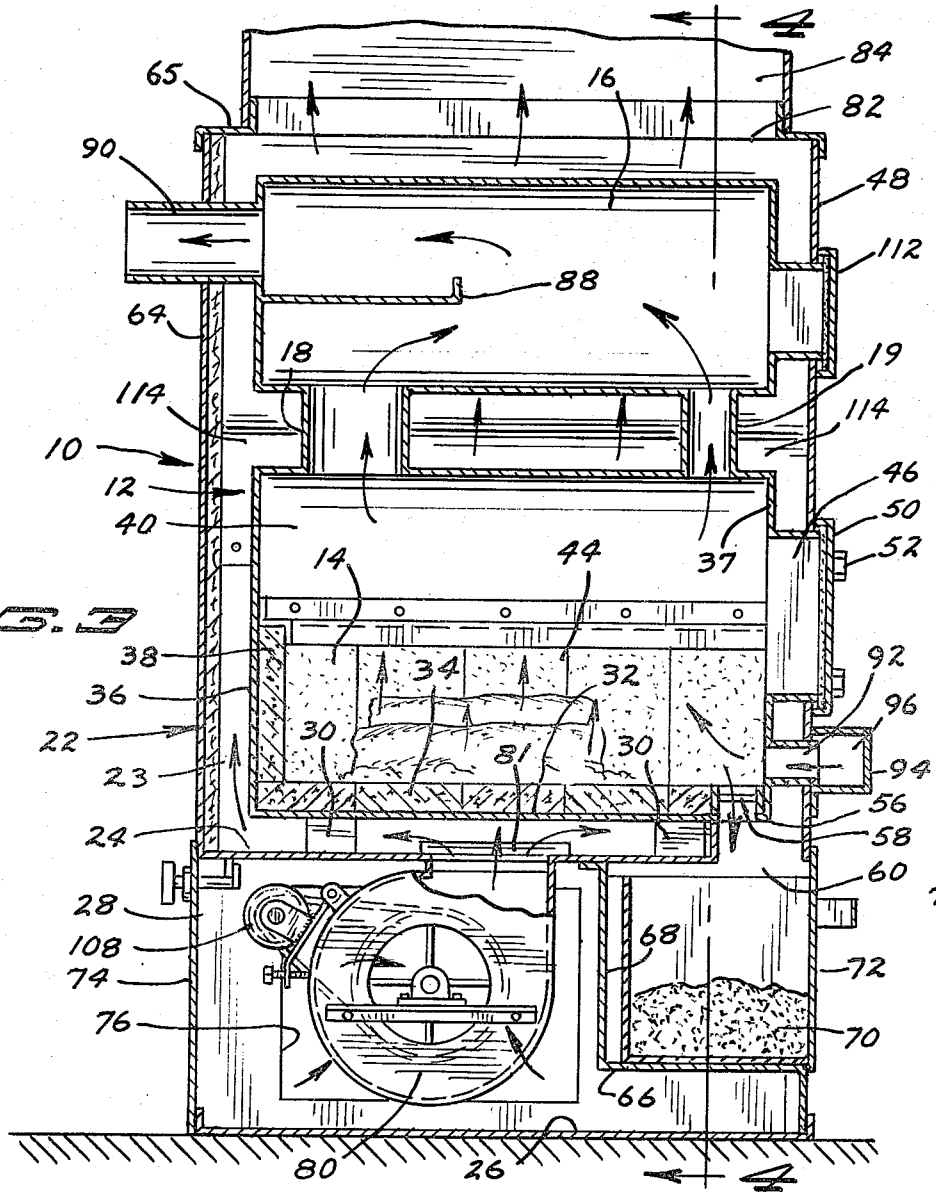
FIG. 3 is a vertical sectional view taken on the line 3—3 in FIG. 2.
Figure 5:
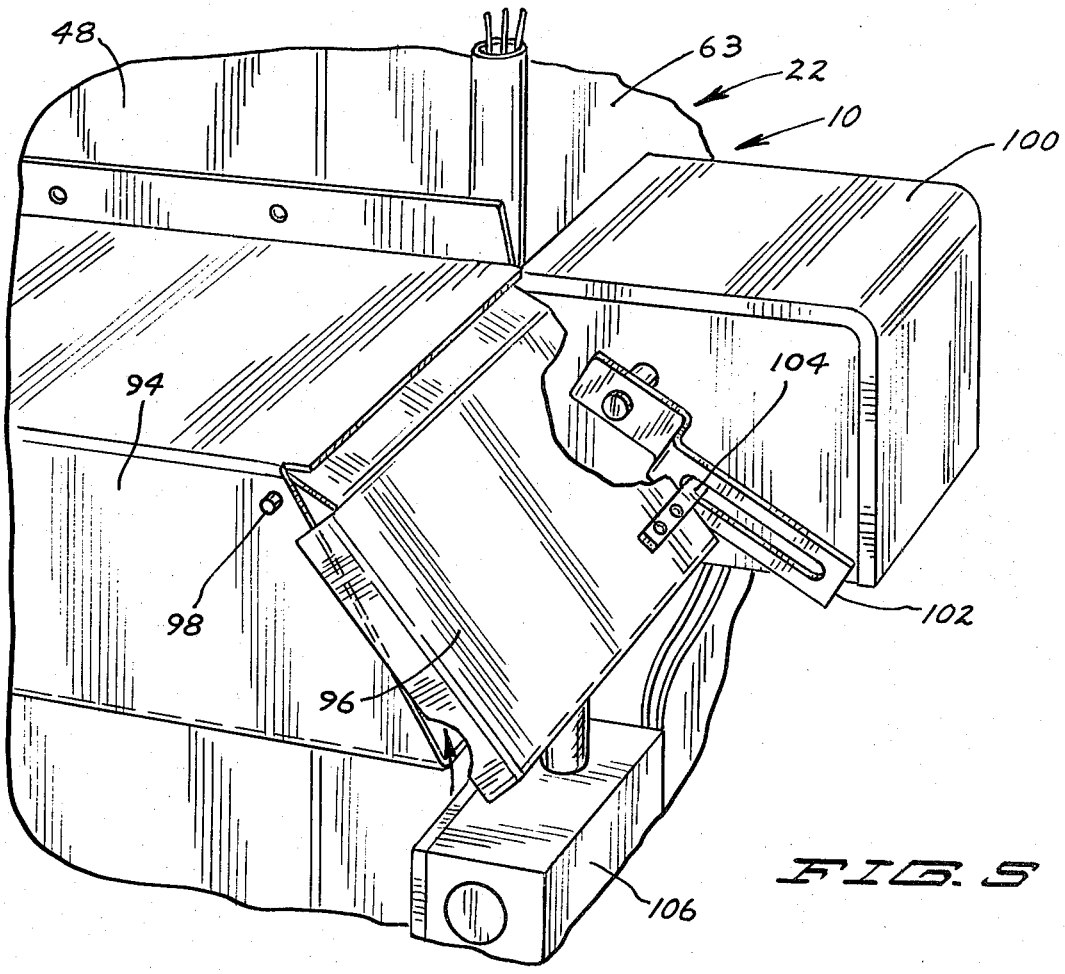
FIG. 5 is a perspective view of the damper of the furnace showing its relationship to a heat regulator motor for controlling the amount of draft air entering the fire box.
Figure 6:
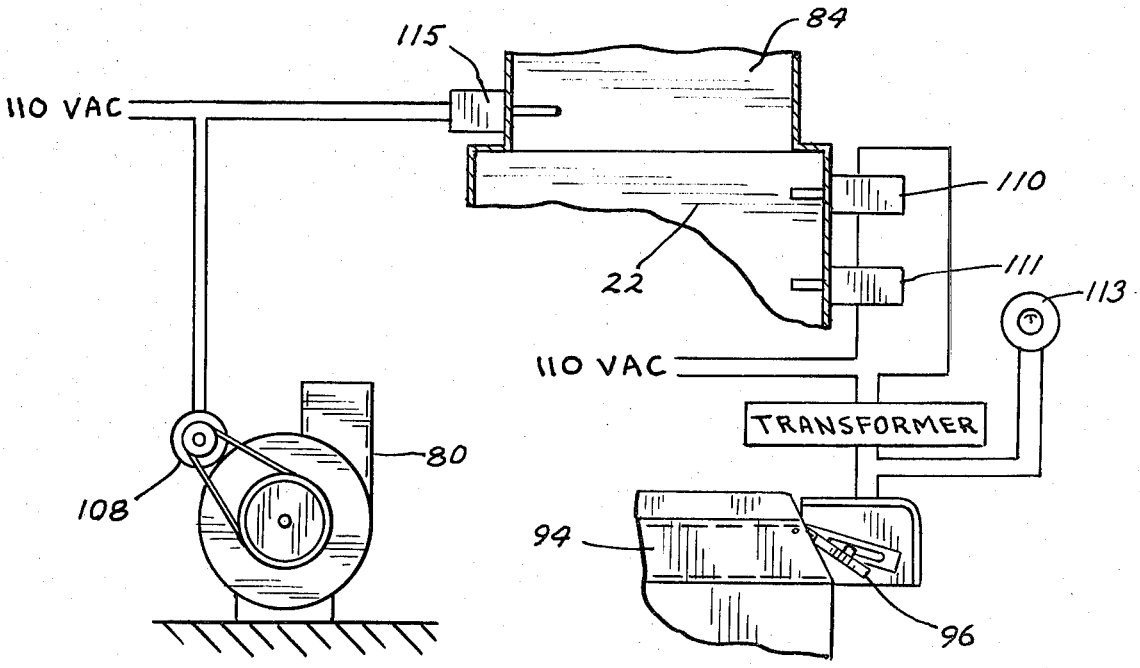
FIG. 6 is a circuit diagram showing one way to operate the furnace controls.

The ash compartment 60 is fashioned out of the fan compartment 28 and is of welded construction in the form of the invention as shown so as to prevent any interchange of air, dust, ashes or other deleterious materials between it and the fan compartment. The ash compartment is defined by a horizontal floor 66, a vertical rear ash compartment wall 68 and vertical side walls 69,69. An ash drawer 70 is slidably mounted on the horizontal floor 66 and has a front wall 72 which closes the front of the ash compartment when the ash drawer is in place, as best seen in FIGS. 1 and 3.

As stated, the fan compartment 28 is partially defined by the partition 24, side walls 62 and 63 and floor 26 of the furnace shell 22. It is also defined by a vertical rear fan compartment access panel 74, ash compartment 60, and the vertical front shell wall 48. As best seen in FIGS. 3 and 4, a cold air return opening 76 is provided in furnace shell side wall 62 to permit access of the cold air returning from a cold air return duct 78 to the fan compartment 28. A centrifugal fan 80 draws the cold air into the fan compartment through cold air return duct 78 and opening 76 and discharges it through a provided opening 81 in the horizontal partition 24 to force this heating air into intimate contact with substantially all faces of the two phase combustion zone 12 to the end that it is heated and discharged through an opening 82 in top wall 65 of the furnace shell 22 and from there to a plenum 84 and to areas where the heated air is to be used (not shown).

A cold air return filter 86 can be situated in the cold air return opening 76 to filter the air coming from the cold air return duct 78.

Should isolated areas of the walls of the two phase combustion enclosure or zone 12 vary substantially over or under the average temperature of those walls, whatever that temperature may be at a particular time, warping of the walls will result. Continuous warping and tendency to warp will eventually result in failure by rupture of the walls.

In order to minimize hot and cold spots around the various wall surfaces of the combustion zone, the flow of heating air is kept to substantially the same rate over those surfaces. To accomplish this, heating air baffles 114,114 are provided in substantially parallel relationship to the lower cylindrical surfaces of the upper smoke chamber 16 and to the upper surface of the semicylindrical dome 20 of the lower fire box 14.

As best seen in FIGS. 3 and 4, a so-called smoke baffle 88 is located in the upper smoke chamber 16 to insure that smoke and other products of combustion entering the rearward portion of the upper combustion chamber are forced back in direction toward the front of that chamber before being discharged out of a stack 90. Stack 90 extends out of an upper rear portion of the upper smoke chamber and through the vertical rear wall 64 of the furnace shell 22 to discharge vertically upwardly.

A rectangular damper collar 92 extends integrally outwardly from the front end wall 37 of the fire box 14 through wall 48 of the shell 22, and opens into a damper tunnel 94 which terminates at a damper door 96 pivotally mounted as at 98 to the tunnel 94.

A heat regulator motor 100 is mounted to the side wall 63 of the shell and has a slotted operating arm 102 which receives a damper door handle 104 which is permanently mounted to the damper door 96 in such a manner as to be able to open or close that door as draft is needed and as draft is to be shut off.

An electrical junction box 106 is also mounted to the shell 22 and includes the necessary relays and electrical connections to activate the blower or fan motor 108 and the fan 80, and to activate the heat regulator motor 100 and consequently the damper door 96.

A first temperature probe 110 and a second temperature probe 111 are situated in the heating air passage in adjacent but spaced relation with respect to the smoke chamber 16 and are connected through an appropriate conduit to the junction box 106. A room thermostat 113 situated in a room or other area to be heated can be of any usual or preferred construction and is likewise wired through the electrical junction box to call for opening of damper door 96 when temperature of the room to be heated falls below a set level. A third temperature probe 115 is situated in the plenum 84 and wired to the thermostat in such a manner as to insure that the fan doesn't operate until hot air is available.

As best seen in FIG. 3, a clean-out door 112 for the smoke chamber 16 opens from inside of the smoke chamber to outside of the shell 22.

As seen in FIGS. 1, 3 and 4, all of the vertical walls 62, 63 and 64 of the rectilinear furnace shell 22 are insulated above the fan compartment and the ash compartment to reduce heat losses.

OPERATION

In one form of the invention, thermostat 113 will be initially set to cause damper door 96 to remain open. To put the furnace into operation, the fire door 50 is opened, and kindling, wood, and a fire is introduced into the fire box. With the damper door 96 clear open, the fire will rapidly increase in heat ouput until such time as the maximum set temperature at the thermostat 113 is reached, at which time the thermostat will cause the heat regulator motor 100 to close the damper door 96, retarding combustion in the fire box.

Meanwhile, as soon as the third temperature probe 115 in the plenum 84 reaches its threshold temperature, of say 100° F. (39° C.), the blower motor 108 will be activated to cause the centrifugal fan 80 to force air through the heating air passage, and into the plenum and into the room(s) to be heated. The fan will continue to blow until the temperature at the probe 115 reaches 80° F. (27°).

Because of the design of the furnace, the heating air passage will have approximately the same area in each of a progression of horizontal planes extending from the bottom of the fire box to halfway up the smoke chamber, so that the rate of air flow over the surface of the outer walls of the fire box and the outer walls of the smoke chamber which make up the walls of the combustion enclosure will be approximately uniform throughout. This will cause substantially uniform expansion and contraction of all of the parts of the two-phase combustion zone or enclosure so that there will be little if any tendency to warp as the furnace moves through its various temperature ranges in the normal course of its operation.

The heat regulator motor 100 is of the type that will automatically move to close the damper door 96 should there be a power failure.

The temperature probe 110 will have a threshold point higher than that of second temperature probe 111. For example, for probe 110, 200° F. (94° C.); and for probe 111, 180° F. (83° C.). The power to motor 100 passes through probes 110 and 111 in series. The probe 111 will open to cause the damper 96 to be closed when the temperature reaches its threshold. Should temperature probe 111 fail to close down the damper door upon reaching its lower threshold temperature, the damper door will be closed down by operation of the first temperature probe 110 when its threshold temperature is reached.

When the damper door 96 is closed, the fire will continue to glow in the fire box, but the rate of combustion of the wood logs or other solid fuel will be greatly reduced. In order to further conserve this fuel during the nighttime, for example, the room thermostat can be set down to say 65° F. (19° C.). Because of this lower demand for heat and because of the fact that during the nighttime hours there are less heat losses due to the opening of outside house doors, etc., the furnace of the invention has no difficulty in carrying the wood fire over until morning. In the morning, or whenever else needed, the fire box can be fed with additional logs through the fire door.

It is wll known that there is very little ash residue from burning wood; but when the ashes on the horizontal fire bricks 34 do need to be emptied, the wood which is burning need only be pushed with a poker back to the rear of the fire box or to one or both of the sides, and the ashes raked forward to fall through the grate 58 into the ash drawer 70 in ash compartment 60. The burning logs can then be pulled back into the center of the fire box if desired and further logs can be added if needed. The fire door 50 will then be closed, and the ash drawer 70 will be removed long enough to take the ashes from it, thus temporarily creating a substantial draft to get the fire going again. Once the ash drawer is replaced, the furnace operates in the manner set out above.

As an aid to the full combustion of the wood and its various constituents, the rearward smoke conduit 18 carries the major portion of the hottest elements of the products of the heating and combustion of the wood up into the so-called smoke chamber 16. Some of the smoke and some of the yet unburned constituents of the wood will move up and be carried through the forward smoke conduit 19. Aided by the smoke baffle 88, these products of heating and of combustion coming through these conduits will become mixed and, as indicated by the readings on test temperature probes situated experimentally in the forward part of the smoke chamber 16, further combustion of these volatile constituents of the wood takes place before the remaining substantially fully burned out smoke passes over the top of the baffle plate 88 and out of the stack 90.

When it is desired to shut down the furnace at the end of the heating season or for any other reason, additional fuel is not put into the fire box. To burn up the wood in the fire box, the room thermostat will be set above the point where it will call for heat. This will cause draft door 96 to be opened and the remaining wood in the fire box will burned up almost completely, thus leaving no substantial amount of charred and hard to start unburned residue in the furnace to be disposed of next time the furnace is to be used.

The embodiments of the invention in which an exclusive property or privilege is claimed are defined as follows:

1. A solid fuel burning furnace including:

A. a combustion enclosure made up of:

(1) a closed, generally rectilinear, lower fire box being defined at an upper portion thereof by a semicylindrical roof dome, (2) a closed, cylindrical, upper smoke chamber spaced above and parallel to said fire box roof dome, (3) a rearward upright smoke conduit open between said fire box roof dome and said smoke chamber at a rearward portion of each, and (4) a forward upright smoke conduit open between said fire box roof dome and said smoke chamber at a forward portion of each;

B. an outer, generally rectilinear, furnace shell encompassing said combustion enclosure, said shell also providing a closed fan compartment below said combustion enclosure;

C. a fire box loading collar open to said fire box through a forward wall of said shell for loading fuel inside said fire box;

D. a normally closed fire door mounted with respect to said collar to be openable to permit access to said fire box;

E. a stack open to a rear portion of said smoke chamber and extending out through said shell;

F. a blower in said fan compartment;

G. heating air passage baffles integral with the interior of said shell;

H. said baffles and the interior of said shell being in generally parallel spaced relation to the flat and cylindrical surfaces of said fire box and smoke chamber so as to provide a heating air passage of generally uniform cross sectional area when measured along progressively higher horizontal planes from the bottom of the fire box to halfway up the smoke chamber;

I. a plenum opening being provided in an upper wall of the furnace shell, said plenum opening being of at least the cross sectional area of the smallest area of a horizontal section taken through the heating air passage;

J. said fan compartment being open to said heating air passage in said shell and to unheated air outside said shell;

K. means to activate said blower to cause it to force air from outside said shell, through said heating air passage and out said plenum opening; and L. draft means to introduce primary combustion air into a lower portion of said fire box through said shell.

2. The solid fuel burning furnace of claim 1 wherein:

M. said fire box is defined at a lower portion thereof by vertical front, rear and side walls and by a horizontal floor;

N. said horizontal fire box floor is provided with an ash clean-out opening immediately adjacent said front fire box wall; and O. a closed ash receptacle is positioned inside of said furnace shell below said fire box floor opening, said ash receptacle including an ash compartment open through said furnace shell and an ash drawer positionable below said fire box floor opening and in closing relation to said ash compartment when said drawer is installed in said compartment, said drawer being removable through said furnace shell to clear out ashes therein.

3. The solid fuel burning furnace of claim 1 wherein:

M. temperature responsive means is located in position to sense the temperature of air in the heating air passage adjacent an upper portion of said combustion enclosure;

N. said draft means includes:

i. a draft tunnel open through said furnace shell and through said fire box wall at a location lower than said fire door, ii. an openable, normally closed, draft door mounted with respect to said draft tunnel, and iii. heat regulator means operative to open and keep open said draft door when the air temperature at said temperature responsive means is below a predetermined threshold level and to close the draft door when said temperature reaches or exceeds said threshold level.

4. The solid fuel burning furnace of claim 2 wherein:

P. temperature responsive means is located in position to sense the temperature of air in the heating air passage adjacent an upper portion of said combustion enclosure;

Q. said draft means includes:

i. a draft tunnel open through said furnace shell and through said fire box wall at a location lower than said fire door, ii. an openable, normally closed, draft door mounted with respect to said draft tunnel, and iii. heat regulator means operative to open and keep open said draft door when the air temperature at said temperature responsive means is below a predetermined threshold level and to close the draft door when said temperature reaches or exceeds said threshold level.

5. The solid fuel burning furnace of claim 4 wherein:

R. a clean-out opening, including a normally closed, openable clean-out door is provided in a forward wall of said smoke chamber and opens through said furnace shell;

S. said rear and side walls and said floor of said fire box include a lining of fire bricks; and T. said fire door, the rectilinear walls of said furnace shell, and said smoke chamber clean-out door include a layer of heat insulating material.

6. The solid fuel burning furnace of claim 5 wherein:

U. said smoke chamber is provided with a horizontal smoke baffle extending from a rear end wall of said smoke chamber in spaced relation above and covering said rearward smoke conduit, said baffle terminating substantially short of said forward smoke conduit, and said baffle being below said stack opening to said smoke chamber.

7. The solid fuel burning furnace of claim 6 wherein:

V. said plenum opening in said furnace shell discharges heated air to a plenum for distribution to a location for use of said air; and W. said fan compartment is open to a cold air return duct to receive return air from said use location.

* * * * *